US008162492B2

(12) United States Patent
Cho

(10) Patent No.: US 8,162,492 B2
(45) Date of Patent: Apr. 24, 2012

(54) FOLDABLE DELINEATOR

(75) Inventor: Nam-Ho Cho, Seoul (KR)

(73) Assignee: I AN C&S Co., Ltd. (KR)

( * ) Notice: Subject to any disclaimer, the term of this patent is extended or adjusted under 35 U.S.C. 154(b) by 0 days.

(21) Appl. No.: 13/056,641

(22) PCT Filed: Mar. 10, 2009

(86) PCT No.: PCT/KR2009/001196

§ 371 (c)(1),
(2), (4) Date: Jan. 28, 2011

(87) PCT Pub. No.: WO2010/013878

PCT Pub. Date: Feb. 4, 2010

(65) Prior Publication Data

US 2011/0134527 A1 Jun. 9, 2011

(30) Foreign Application Priority Data

Jul. 31, 2008 (KR) ..... 10-2008-0075025

(51) Int. Cl.
*G02B 5/12* (2006.01)

(52) U.S. Cl. ..... 359/552; 359/532

(58) Field of Classification Search ..... 359/532, 359/547, 552; 404/9–10, 16; 116/63 R, 116/63 P, 63 C, 63 T
See application file for complete search history.

(56) References Cited

U.S. PATENT DOCUMENTS 4,191,449 A * 3/1980 Hirata ..... 359/552
4,221,498 A * 9/1980 Schueler et al. ..... 404/9

FOREIGN PATENT DOCUMENTS

JP 10-159041 A 6/1998
KR 20-2000-0003472 7/2000
KR 20-0229389 Y1 4/2001
KR 20-0399108 Y1 10/2005
WO 2007/062452 A1 6/2007

* cited by examiner

*Primary Examiner* — James Phan
(74) *Attorney, Agent, or Firm* — David R. Stevens; Stevens Law Group

(57) ABSTRACT

A foldable delineator comprises: a fixing plate (100) installed at a guardrail or a protective wall and having one or more first hinge coupling portions (110) formed by bending corners thereof; a pivotal plate (200) at which a reflective panel fixing frame (30) to which a reflective panel (10) is coupled by means of a bolt is installed, the pivotal plate (200) having one or more hinge coupling portions (210) coupled to the first hinge coupling portions (110) by means of a hinge (20) and formed by bending corners of the pivotal plate (200), one or more bending preventing bosses (220) protruding along a lengthwise direction of the pivotal plate (200) on one surface of the pivotal plate (200), and one or more bending preventing portions (230) formed by bending lengthwise edges of the pivotal plate (200) toward the protrusion direction of the bending preventing bosses (220); a stopper (120) for limiting the pivoting movement of the pivotal plate (200) to a range of 90 degrees with the pivotal plate (200) being coupled to the fixing plate (100) by means of the hinge (20); a coil spring (300) installed around the hinge (20) to support the fixing plate (100) and the pivotal plate (200) resiliently; and a coupling recess (400) formed in the fixing plate (100) or the pivotal plate (200) such that one end of the coil spring (300) is inserted and fixed thereinto.

2 Claims, 15 Drawing Sheets

FOLDABLE DELINEATOR

TECHNICAL FIELD

The present invention relates to a foldable delineator installed at a guardrail or a protective wall, and more particularly to a foldable delineator that always maintains a certain reflection angle by, upon collision of a vehicle with a reflective panel, absorbing an impact and restoring the reflective panel to the original state with a restoring resilient force of a coil spring.

BACKGROUND ART

In general, delineators are installed at guardrails or protective walls to allow drivers to secure clear views during night driving. Such delineators prevent in advance vehicles from colliding with guardrails or protective walls by reflecting light emitted from headlamps of vehicles toward drivers.

However, since delineators are installed at guardrails or the like, they frequently collide with vehicles directly. Therefore, various methods for reducing impulses of vehicles caused by impacts have been suggested.

For example, as shown in FIGS. 1 and 2, Korean Utility Model Application No. 20-2000-0003472 suggests a guardrail delineator which has a body 1 made of urethane rubber and which is fixedly secured to a guardrail 2 with a fixing member 4 with the body 1 being mounted to an upper end portion of the guardrail 2 using an insert slit 3 formed in the body 1.

The conventional guardrail delineator 1 maintains the reflection angle of a reflective body fixing frame 5 constant in such a manner that, upon collision with a vehicle against a guard rail, the body 1 made of urethane rubber is bent and is restored.

However, the delineator may be fatigued and cracked by an impact exceeding a bending limit of the body 1 made of urethane rubber or due to weakening of the rubber material. In particular, as the ductility of the urethane rubber body 1 becomes lower and its rigidity becomes higher during freeze-up seasons, the body 1 is easily damaged even by a relatively weak impact.

Furthermore, the coupling surface of the guardrail 2 to the body 1 is exposed to the outside, thus hampering the appearance of a road.

DISCLOSURE

Technical Problem

It is, therefore, an object of the present invention to provide a foldable delineator that can always maintain a certain reflection angle by, upon collision of a vehicle with a reflective panel, absorbing an impact and restoring the reflective panel to the original state with a restoring resilient force of a coil spring.

It is another object of the present invention to provide a foldable delineator by which a reflective panel can be simply installed regardless of an installation place using an installation hole for a guardrail and an installation hole for a protective wall.

It is still another object of the present invention to provide a foldable delineator that can prevent bending of a pivotal plate due to an impact caused during collision of a reflective panel with a vehicle using a bending preventing boss and a bending preventing portion formed in the pivotal plate.

Technical Solution

In accordance with an aspect of the present invention, there is provided a foldable delineator comprising: a fixing plate (100) installed at a guardrail or a protective wall and having one or more first hinge coupling portions (110) formed by bending corners thereof; a pivotal plate (200) at which a reflective panel fixing frame (30) to which a reflective panel (10) is coupled by means of a bolt is installed, the pivotal plate (200) having one or more hinge coupling portions (210) coupled to the first hinge coupling portions (110) by means of a hinge (20) and formed by bending corners of the pivotal plate (200), one or more bending preventing bosses (220) protruding along a lengthwise direction of the pivotal plate (200) on one surface of the pivotal plate (200), and one or more bending preventing portions (230) formed by bending lengthwise edges of the pivotal plate (200); a stopper (120) for limiting the pivoting movement of the pivotal plate (200) to a range of 90 degrees with the pivotal plate (200) being coupled to the fixing plate (100) by means of the hinge (20); a coil spring (300) installed around the hinge (20) to support the fixing plate (100) and the pivotal plate (200) resiliently; and a coupling recess (400) formed in the fixing plate (100) or the pivotal plate (200) such that one end of the coil spring (300) is inserted into and fixed to the coupling recess (400).

An installation hole (101) for a protective wall or a installation hole (102) for a guardrail may be formed in the fixing plate (100).

ADVANTAGEOUS EFFECTS

According to the invention, a foldable delineator can always maintain a certain reflection angle by, upon collision of a vehicle with a reflective panel, absorbing an impact and restoring the reflective panel to the original state with a restoring resilient force of a coil spring.

Furthermore, a reflective panel can be simply installed regardless of an installation place using an installation hole for a guardrail and an installation hole for a protective wall.

Moreover, the foldable delineator can prevent bending of a pivotal plate due to an impact caused during collision of a reflective panel with a vehicle using a bending preventing boss and a bending preventing portion formed in the pivotal plate.

DESCRIPTION OF DRAWINGS

The above and other objects and features of the present invention will become apparent from the following description of embodiments given in conjunction with the accompanying drawings, in which.

DESCRIPTION OF REFERENCE NUMERALS FOR MAIN COMPONENTS OF THE DRAWINGS

Figure 1:
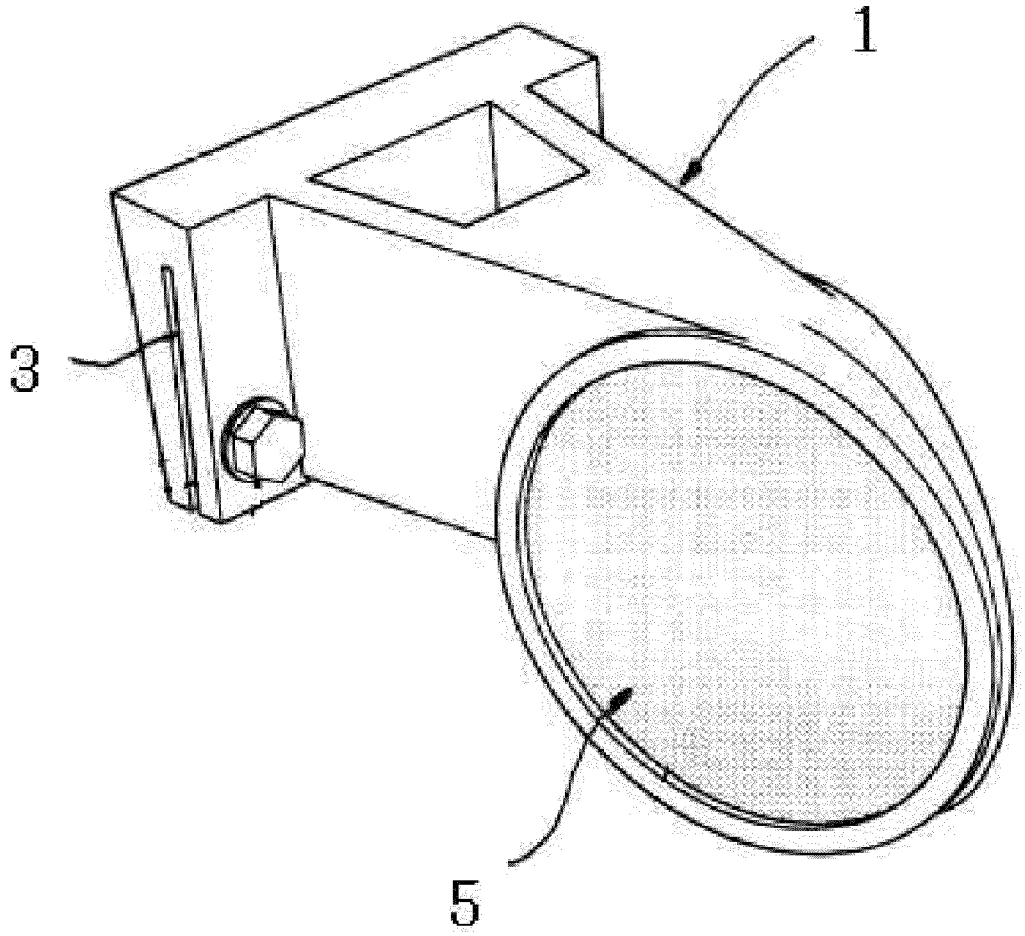
FIG. 1 is a perspective view of a conventional guardrail delineator.
Figure 2:
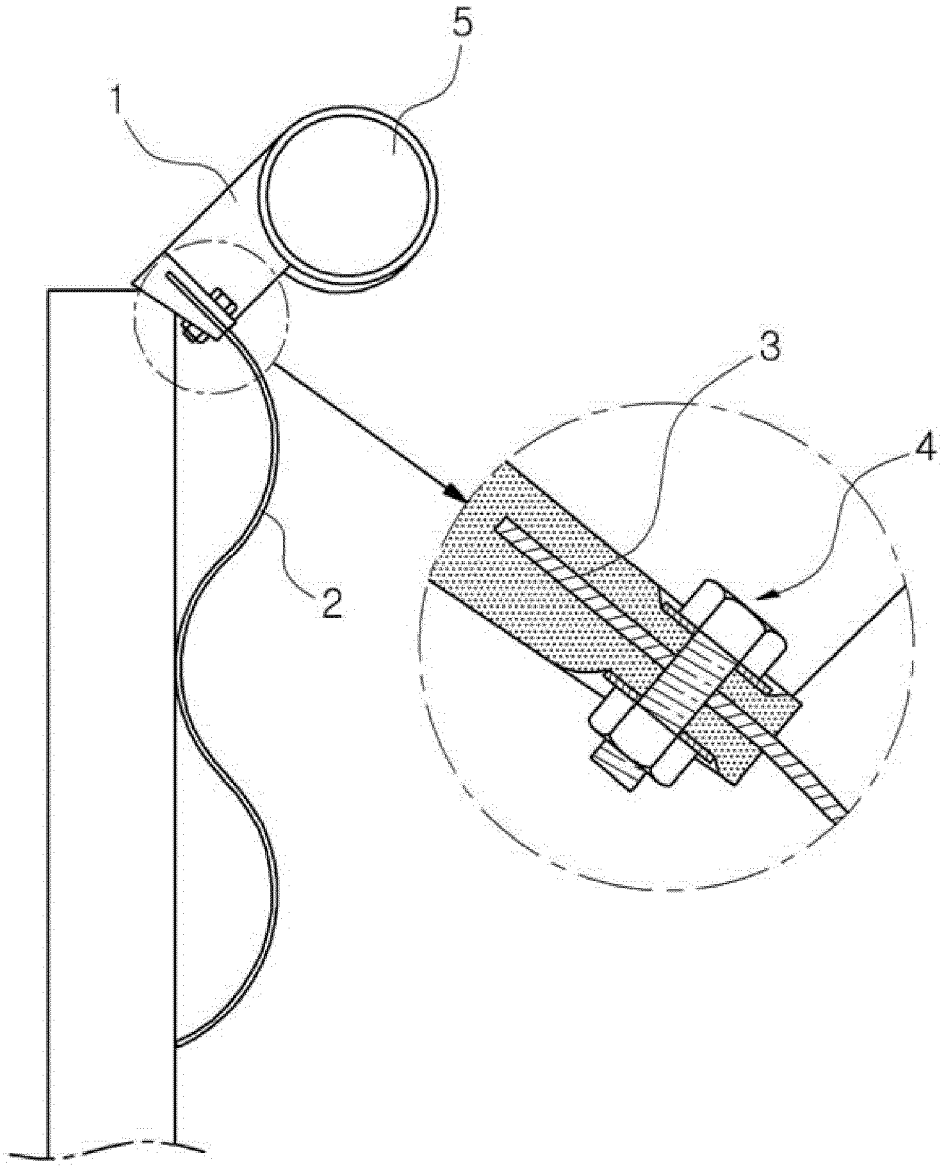
FIG. 2 is a view in which the conventional guardrail delineator is attached to a guardrail.

10: reflective panel 11: 3-D boss
12: reflective surface 13: contact surface
14: bottom surface 20: hinge
30: reflective panel fixing frame 100: fixing plate
101: installation hole for a protective wall
102: installation hole for a guardrail
110: first hinge coupling portion 120: stopper
200: pivotal plate 210: second hinge coupling portion
220: bending preventing boss 230: bending preventing portion
300: coil spring 400: coupling recess

BEST MODEL

Hereinafter, preferred embodiments of the present invention will be described in detail with reference to the accompanying drawings. In the drawings, the same or like reference numerals refer to the same or like members or portions.

Figure 3:
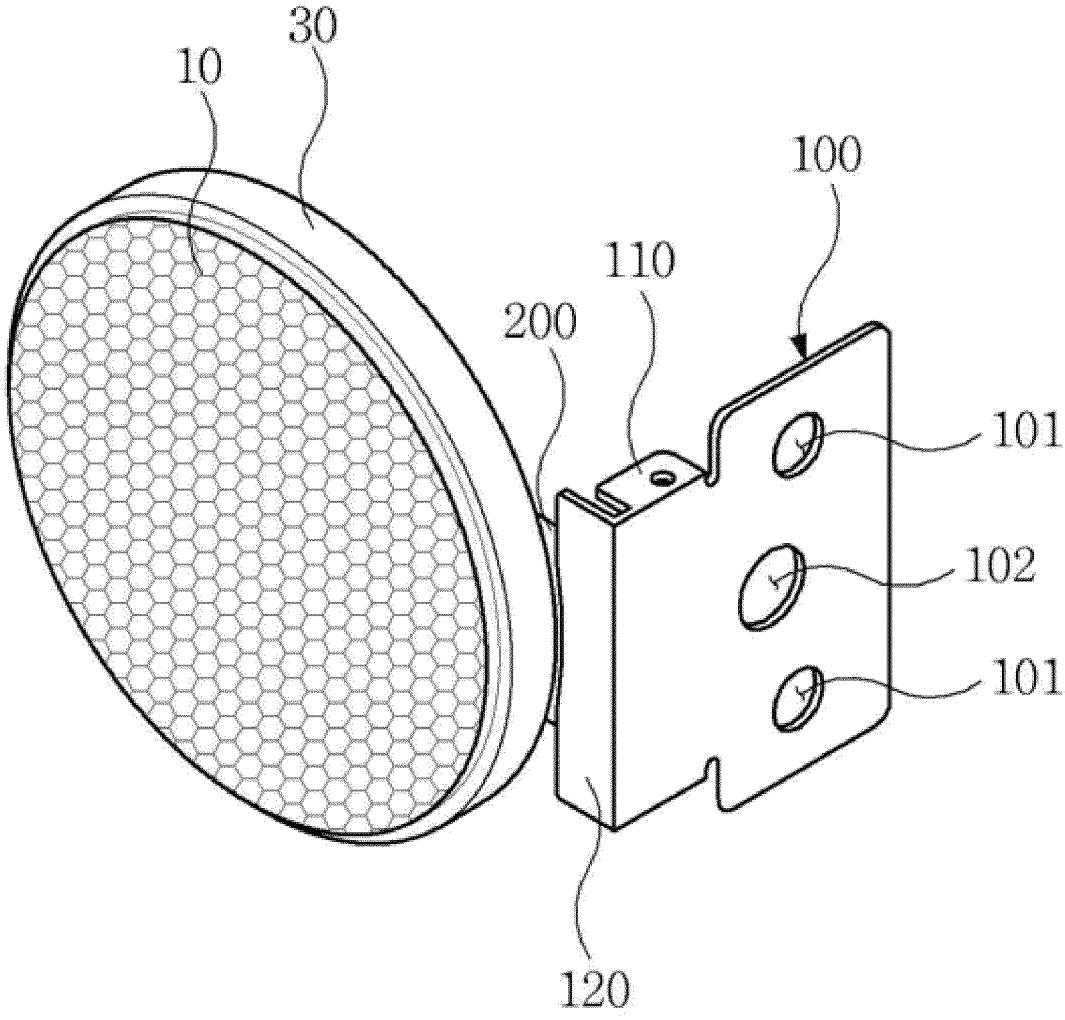
FIG. 3 is a front perspective view of a foldable delineator according to a preferred embodiment of the invention.
Figure 4:
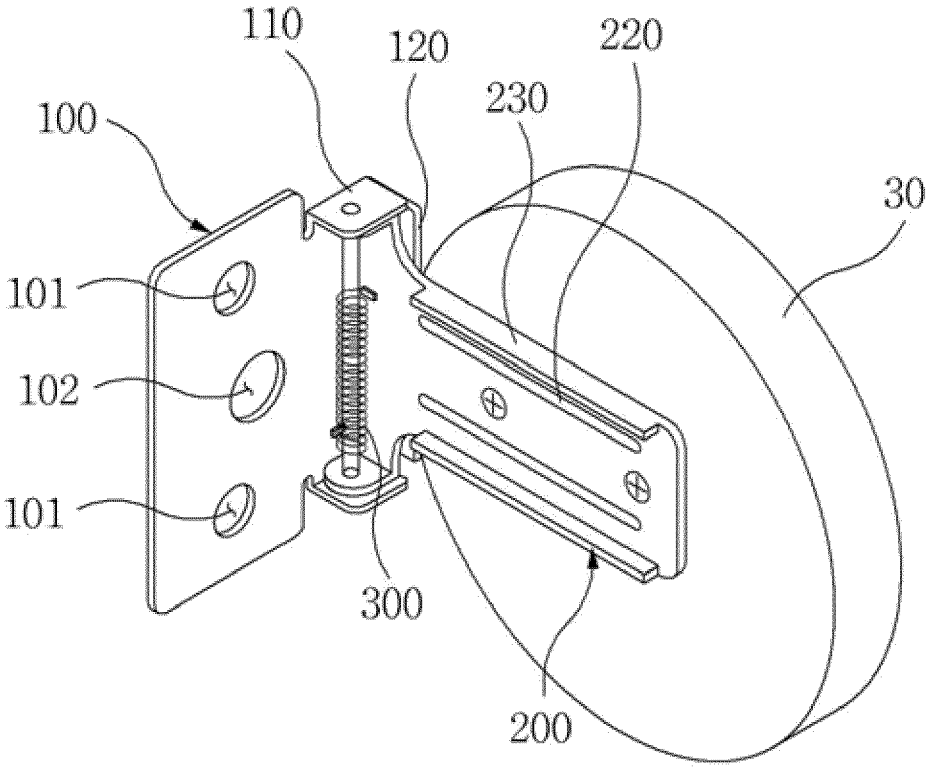
FIG. 4 is a rear perspective view of the foldable delineator according to the embodiment of the invention.
Figure 5:
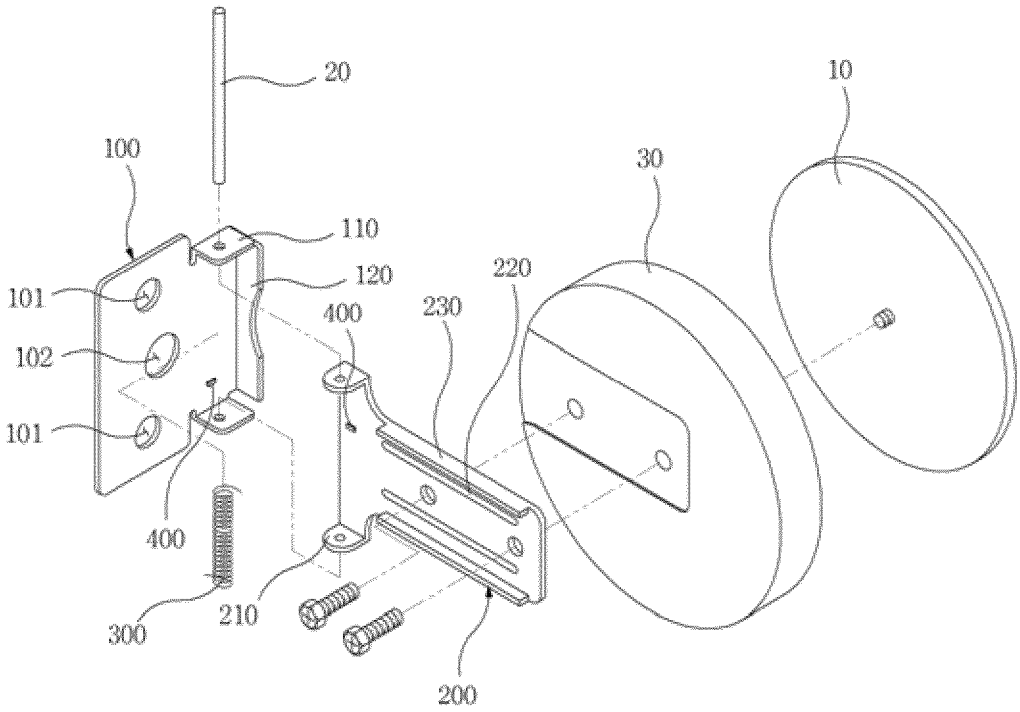
FIG. 5 is an exploded perspective view of FIG. 4.
Figure 6:
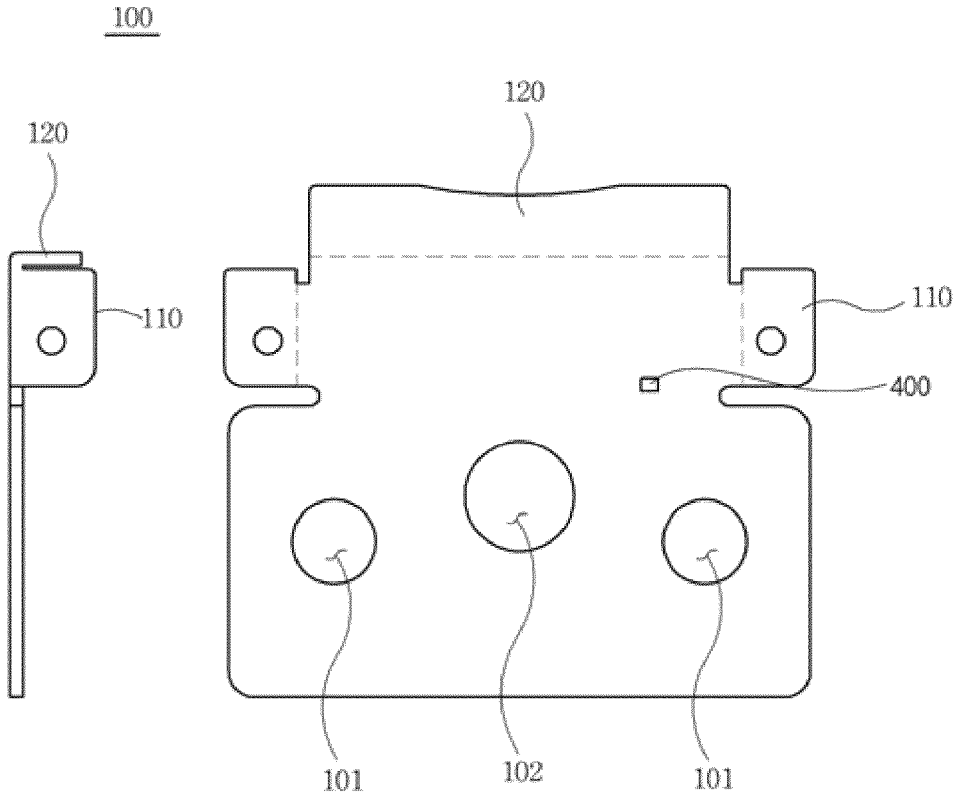
FIG. 6 illustrates a front view in which a fixing plate of the foldable delineator according to the embodiment of the invention is spread out and a side view in which the fixing plate is to be installed.
Figure 7:
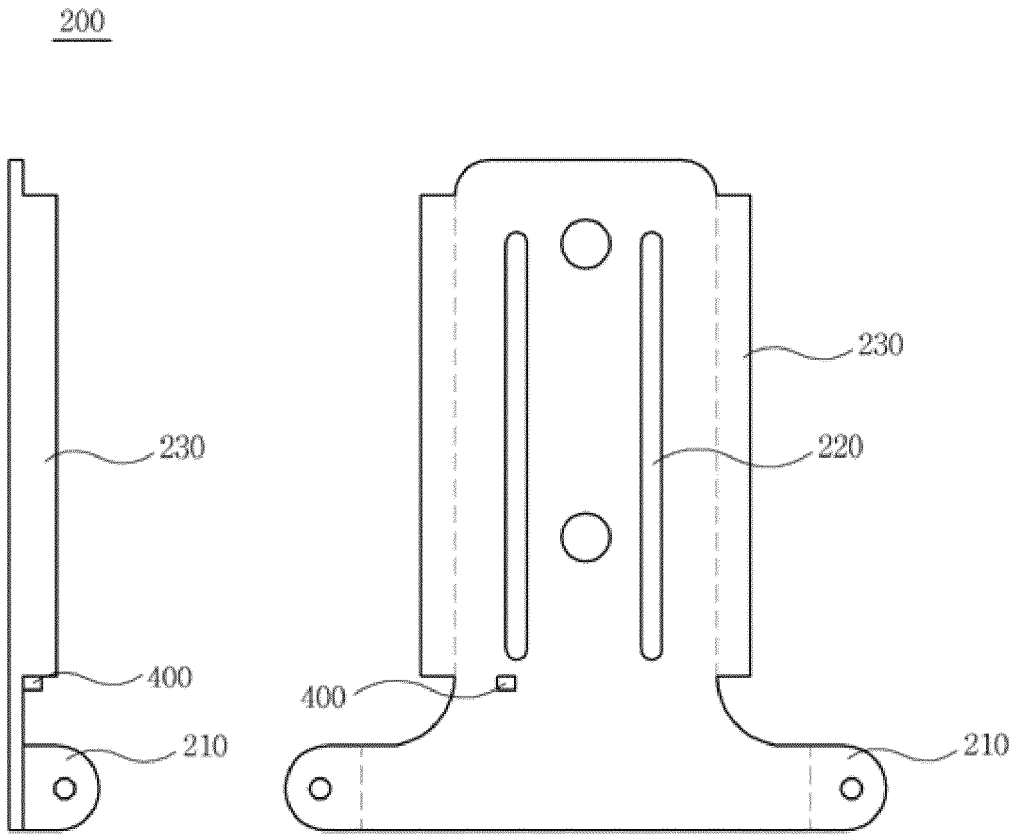
FIG. 7 illustrates a front view in which a pivotal plate of the foldable delineator according to the embodiment of the invention is spread out and a side view in which the pivotal plate is to be installed.

FIG. 3 is a front perspective view of a foldable delineator according to a preferred embodiment of the invention and FIG. 4 is a rear perspective view of the foldable delineator according to the embodiment of the invention. FIG. 5 is an exploded perspective view of FIG. 4. FIG. 6 illustrates a front view in which a fixing plate of the foldable delineator according to the embodiment of the invention is spread out and a side view in which the fixing plate is to be installed. FIG. 7 illustrates a front view in which a pivotal plate of the foldable delineator according to the embodiment of the invention is spread out and a side view in which the pivotal plate is to be installed. The foldable delineator according to the embodiment of the invention includes a fixing plate 100, a pivotal plate 200, a coil spring 300, and one or more coupling recesses 400, and may further include a first hinge coupling portion 110, one or more installation holes 101 for a protective wall, an installation hole 102 for a guardrail, one or more second hinge coupling portions 210, one or more bending preventing bosses 220, and one or more bending preventing portions 230.

The fixing plate 100 is a member which is installed at a guardrail G or a protective wall G', and is coupled to the pivotal plate 200 by means of a hinge 20. As can be seen in FIGS. 3 and 6, the fixing plate 100 can be easily installed at a guardrail G and a protective wall G' using an installation holes 102 for a guardrail and one or more installation holes 101 for a protective wall respectively.

Figure 8:
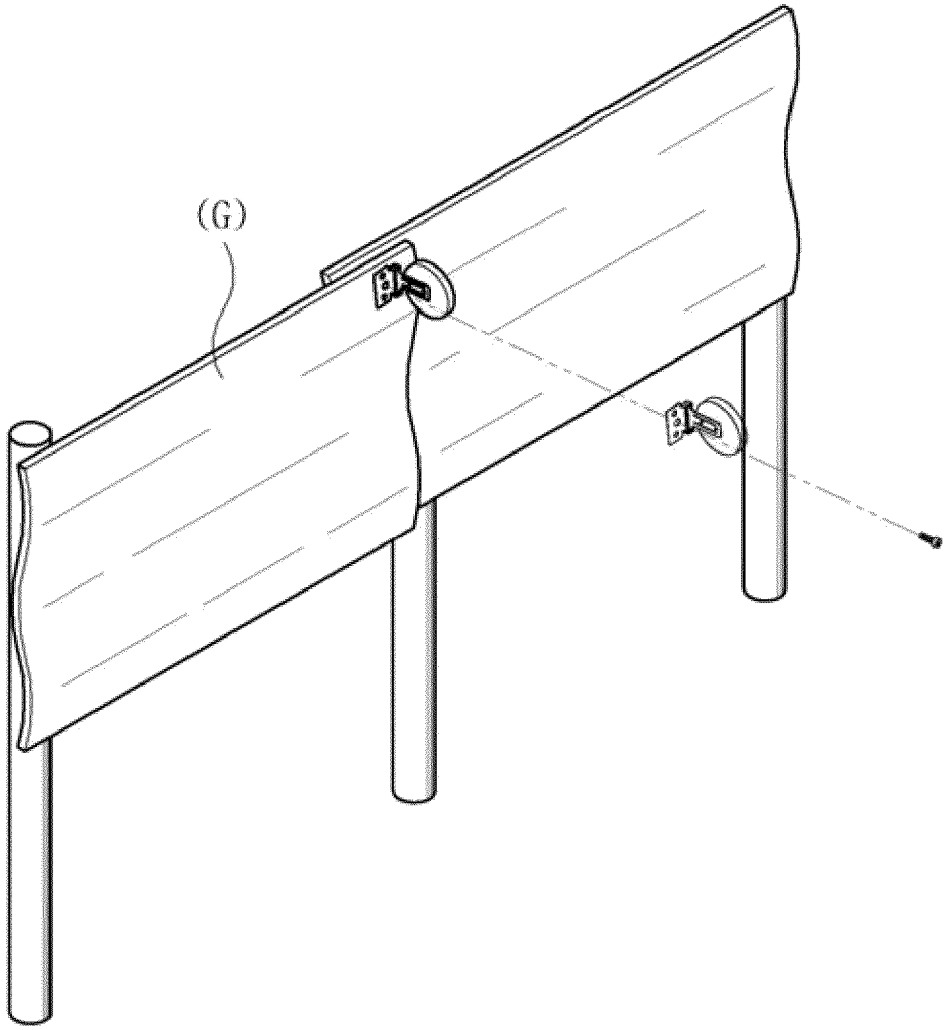
FIG. 8 is an exemplary view in which the foldable delineator according to the embodiment of the invention is mounted to a guardrail.
Figure 9:
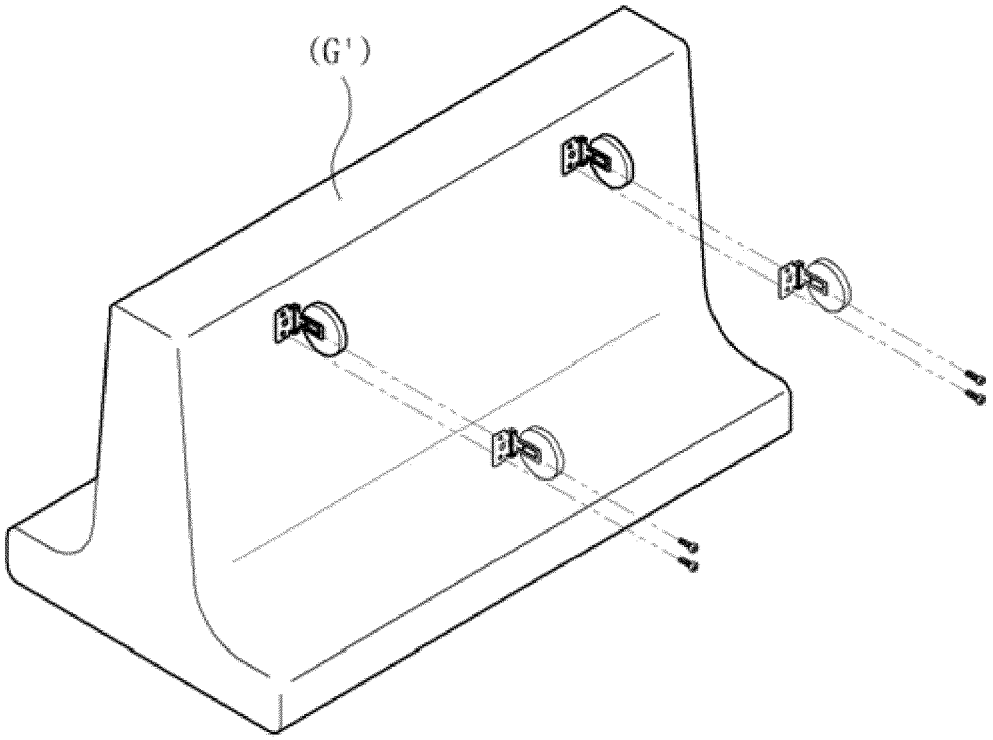
FIG. 9 is an exemplary view in which the foldable delineator according to the embodiment of the invention is mounted to a protective wall.
Figure 10:
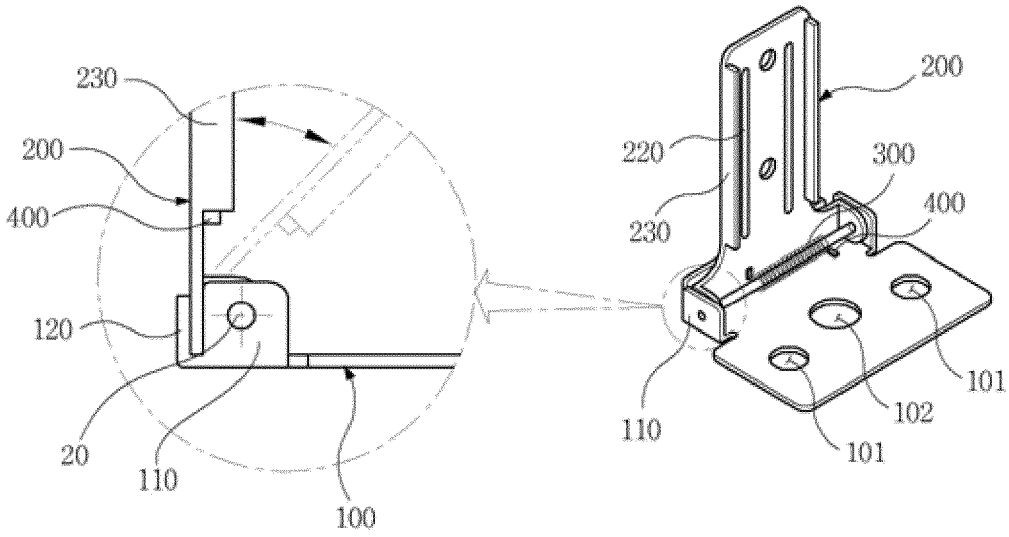
FIG. 10 illustrates a perspective view in which the fixing plate and the pivotal plate of the foldable delineator according to the embodiment of the invention are coupled to each other and an exemplary view in which the pivotal plate is being pivoted.

As can be seen in FIGS. 3 to 5, one installation hole 102 for a guardrail is preferably formed at a central portion of the fixing plate 100. Referring to FIG. 8, the installation hole 102 for a guardrail provides a convenience of simply installing the fixing plate 100 to the guardrail G in such a manner that a bolt is inserted into the installation hole 102 for a guardrail after an existing bolt installed in the guardrail G is released.

As can be seen in FIGS. 3 to 5, one or more installation holes 101 for a protective rail are preferable formed on the upper and lower sides of the installation hole 102 for a guardrail. The installation holes 101 for a protective rail provide a convenience of simply installing the fixing plate 100 on an outer surface of the protective wall G'.

That is, the fixing plate 100 may be installed either at a guardrail or a protective wall by means of two types of installation holes functioning in different ways, i.e. the installation holes 102 for a guardrail and the installation holes 101 for a protective wall.

Meanwhile, the first hinge coupling portions 110 are formed by bending corners of the fixing plate 100. As can be seen in FIG. 6, the first hinge coupling portions 110 may be formed by bending dotted portions of the fixing plate 100 inward. The fixing plate 100 is coupled to the pivotal plate 200 by means of the hinge 20 with the opposite sides of the fixing plate 100 being bent, and a stopper 120 is preferably formed on the upper side of the first hinge coupling portions 110 such that the pivotal plate 200 pivoted by means of the hinge 20 can be pivoted within a range of 90 degrees.

The stopper 120 limits the pivoting movement of the pivotal plate 200 to 90 degrees when the pivotal plate 200 is pivoted to the original state, i.e. in the opposite direction to the collision direction by a resilient force of the coil spring 300 with the fixing plate being fixedly secured to the guardrail G or the protective wall G' after an instantaneous impact occurring during collision of the reflective panel 10 with a vehicle diminishes.

The reflective panel 10 which reflects the light emitted from a headlamp of a vehicle is installed on one side surface of the pivotal plate 200. The reflective panel 10 is preferably installed directly at the pivotal plate 200, but may be coupled to a reflective panel fixing frame 30 installed at the pivotal plate 200 as shown in FIG. 5. The reflective panel 10 is preferably screw-coupled to the reflective panel fixing frame 30 by means of bolts but may be coupled to it by ultrasonic fusion or using an adhesive.

The second hinge coupling portions 210 to be coupled to the first hinge coupling portions 110 are formed by bending corners of the pivotal plate 200 to be coupled to the first hinge coupling portions 110. As can be seen in FIG. 7, the second hinge coupling portions 210 may be formed by bending dotted portions of the pivotal plate 200 inward and is coupled to the fixing plate 100 by means of the hinge 20 with the opposite sides of the pivotal plate 200 being bent.

Meanwhile, the bending preventing bosses 220 protrude along a lengthwise direction of the pivotal plate 200 from the pivotal plate 200. The bending preventing bosses 220 serve to prevent bending of the pivotal plate 200 due to an impact applied to the reflective panel 10 during collision with a vehicle, i.e. to increase the rigidity of the pivotal plate 200.

As can be seen in FIG. 7, the bending preventing portions 230 are formed by bending lengthwise edge portions of the pivotal plate 200 and, like the bending preventing bosses 220, serve to prevent bending of the pivotal plate 200 due to an impact applied to the reflective panel 10 during collision with a vehicle.

That is, the bending preventing bosses 220 and the bending preventing portions 230 prevent, in two stages, bending of the pivotal plate 200 due to an impact applied to the reflective panel 10 during collision with a vehicle.

The coil spring 300 serves to absorb an impact caused during collision of the reflective panel 10 and the pivotal plate 200 with a vehicle.

The coil spring 300 is coupled to the hinge 20. Such a coil spring 300 generally absorbs a lengthwise impact, but the coil spring 300 according to the embodiment of the invention is installed on the outer peripheral surface of the hinge 20 such that a resilient force is applied in a direction tangential to an imaginary axis of the coil spring 300.

Accordingly, the coil spring 300 is supported resiliently to absorb an impact applied during collision of the pivotal plate 200 with a vehicle in a state in which one end of the coil spring 300 is in contact with the fixing plate 100 and the opposite end thereof is in contact with the pivotal plate 200.

Referring to FIGS. 6 and 7, the coupling recesses 400 are preferably formed in the fixing plate 100 and the pivotal plate 200 such that opposite ends of the coil spring 300 are fixed to them respectively. If the opposite ends of the coil spring 300 are fixed to the coupling recesses 400, the resilient force of the coil spring 300 is efficiently used and the coil spring 20 is firmly fixed around the hinge 200.

The coupling recesses 400 are preferably formed at the fixing plate 100 and the pivotal plate 200 respectively, but one coupling recess 400 may be formed at one of the fixing plate 100 and the pivotal plate 200.

Hereinafter, the reflective panel 10 installed at the pivotal plate 200 will be described in detail.

The reflective panel 10 reflects light incident from its front surface, and a 3-dimensional (3-D) boss 11 having a hexagonal bottom surface is formed on the rear surface of the reflective panel 10. The 3-D boss 11 includes three reflective surfaces 12 each having a pentagonal shape and protruding from angular points of the bottom surface 14 of the hexagonal shape to reflect light and three contact surfaces 13 each vertically protruding from angular points of the bottom surface 14 of the hexagonal shape to continuously connect one 3D-boss to another.

Figure 11:
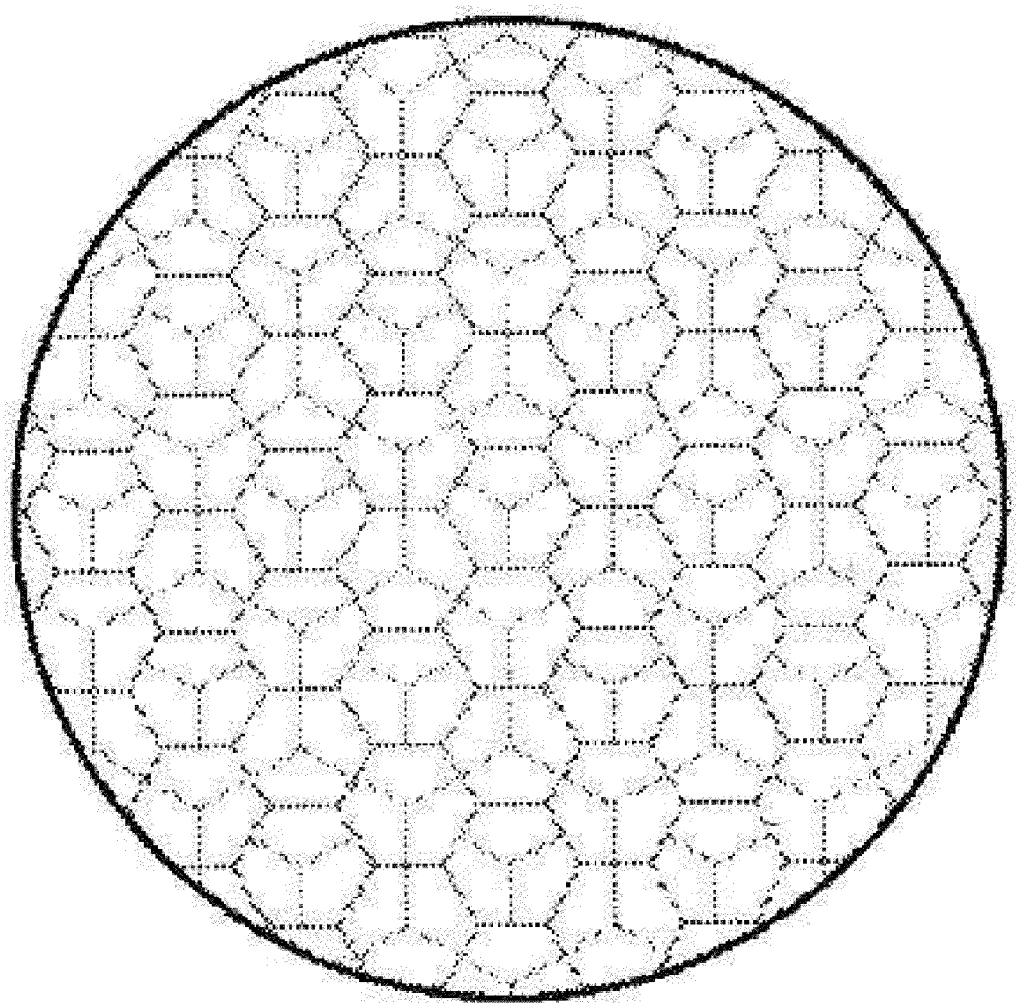
FIG. 11 is a plan view of the pattern of the reflective panel installed at the pivotal plate of the foldable delineator according to the embodiment of the invention.
Figure 12:
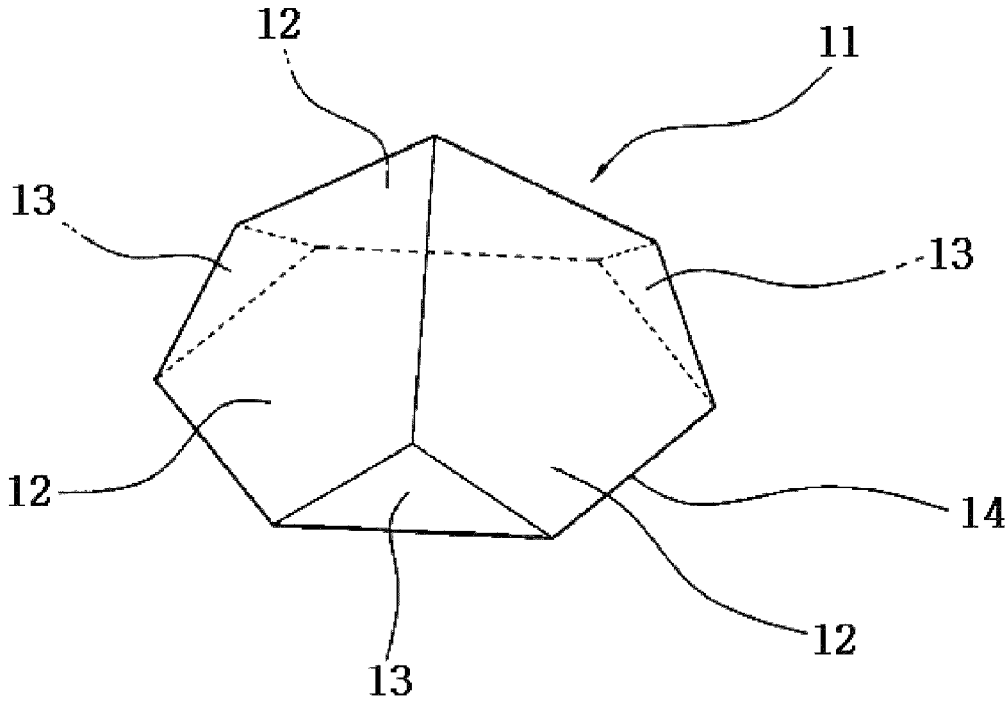
FIG. 12 is a partially enlarged perspective view of the shape of a 3-D boss formed on the rear surface of the reflective panel of the foldable delineator.

FIG. 11 is a plan view of the pattern of the reflective panel installed at the pivotal plate of the foldable delineator according to the embodiment of the invention. FIG. 12 is a partially enlarged perspective view of the shape of a 3-D boss formed on the rear surface of the reflective panel of the foldable delineator.

Figure 13:
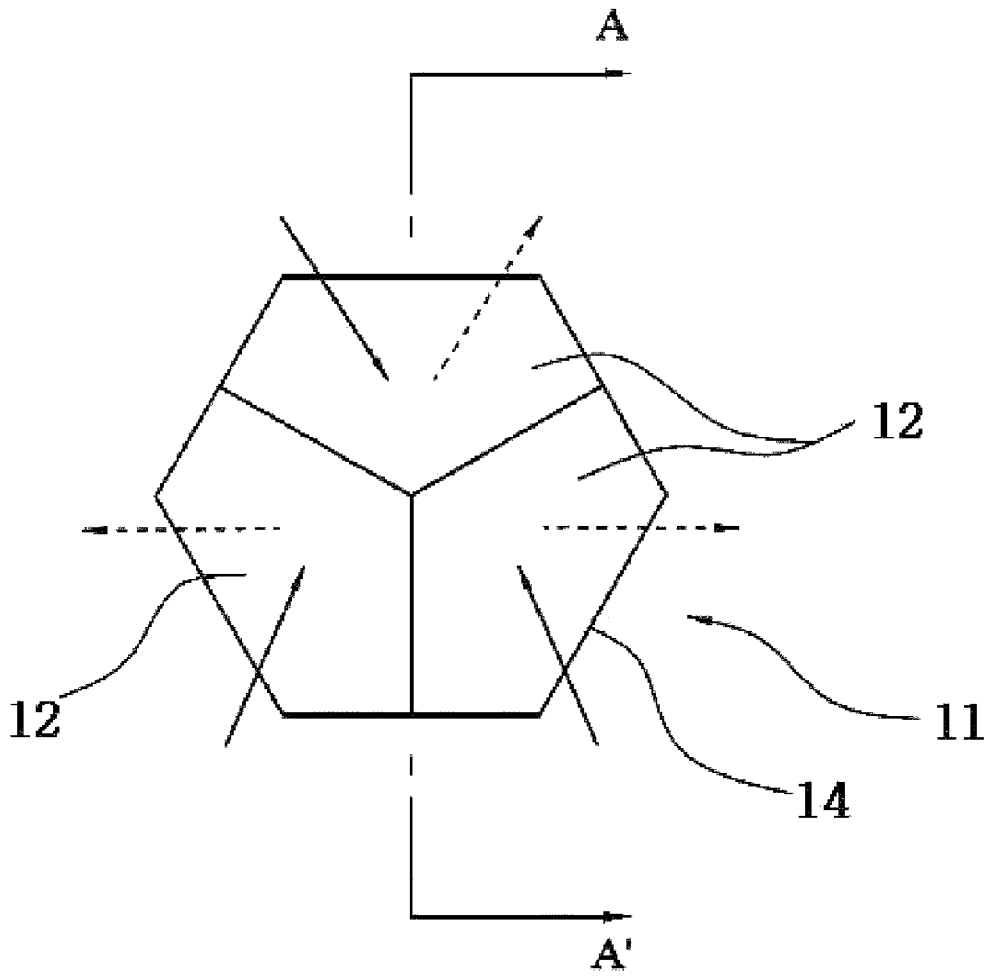
FIG. 13 is a plan view of FIG. 12.

Referring to FIGS. 12 and 13, the 3-D boss 11 formed on the rear surface of the reflective panel 10 has a hexagonal bottom surface, and includes three reflective surfaces 12 each having a pentagonal shape and inclinedly protruding from angular points of the bottom surface 14 of the hexagonal shape to reflect light and three contact surfaces 13 each vertically protruding from angular points of the bottom surface 14 of the hexagonal shape to continuously connect one 3D-boss to another.

Figure 14:
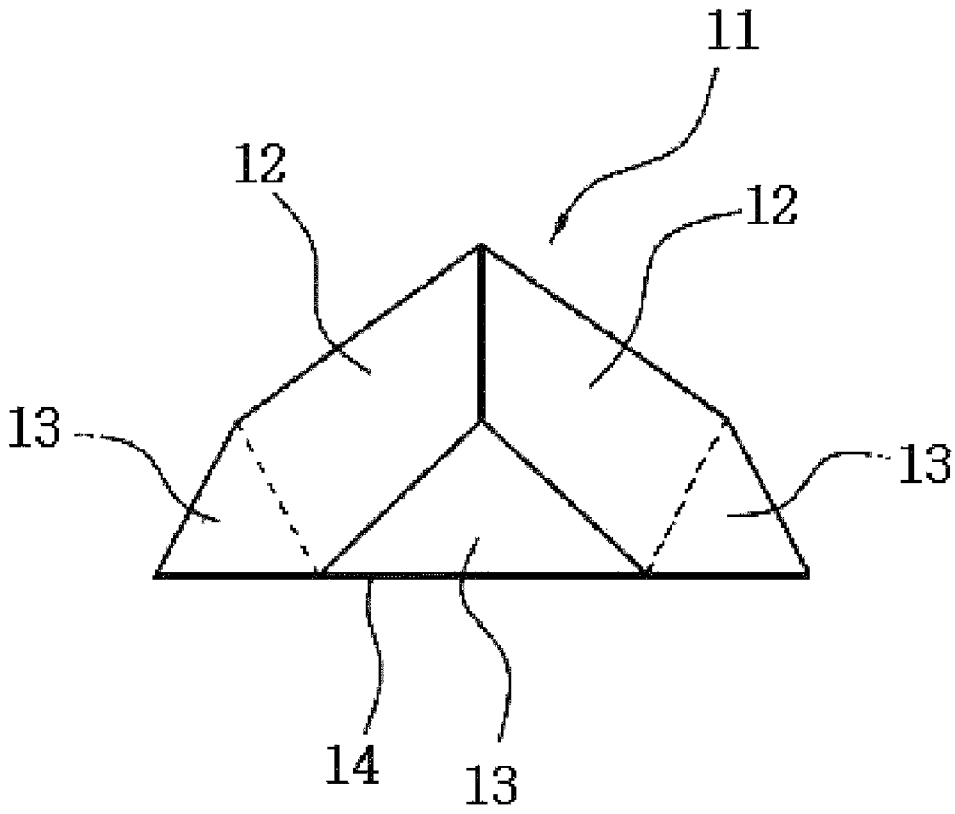
FIG. 14 is a side view of FIG. 12.
Figure 15:
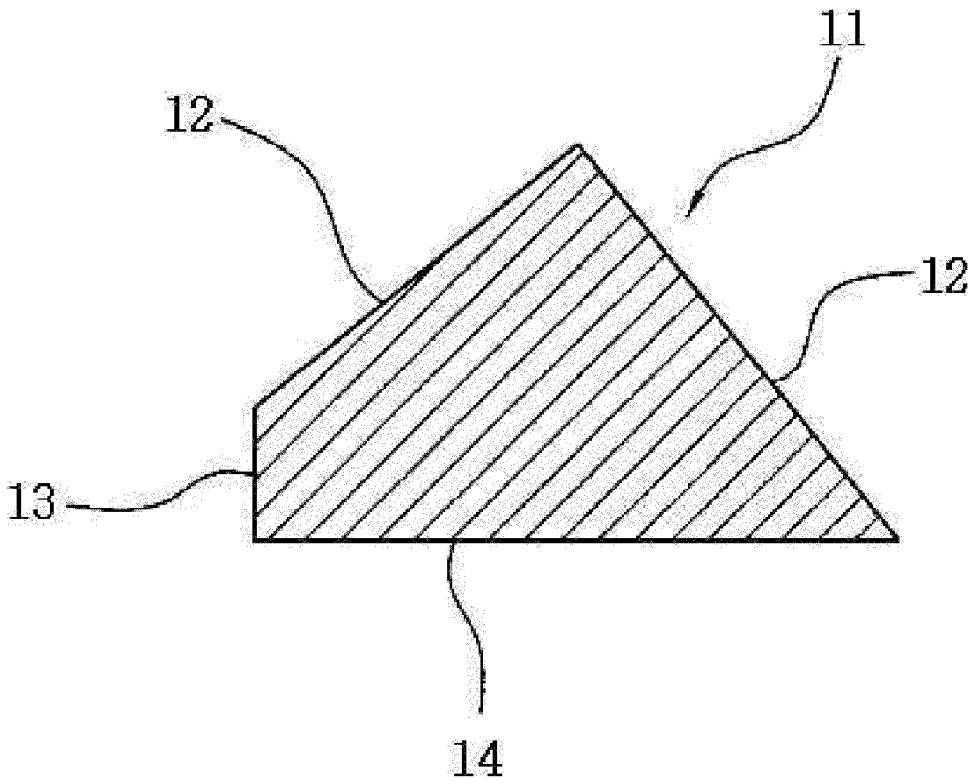
FIG. 15 is a sectional view taken along line A-A' of FIG. 13.

That is, the three reflective surfaces 12 inclinedly protrude from the bottom surface 14 of the 3-D boss 11, and the contact surfaces 13 vertically protruding as in FIGS. 12 and 14 are formed at angular points where the three reflective surfaces are connected to them.

The contact surfaces 23 provide contact surfaces for 3-D bosses 11 when the 3-D bosses are continuously connected to one another.

The 3-D boss 11 has seven surfaces and the center of the 3-D boss 11 protrudes. The bottom surface of the 3-D boss 11 has a hexagonal shape. Three of the six edges of the bottom surface 14 protrude such that the three pentagonal reflective surfaces 12 is inclined toward the center of the 3-D boss 11 and the other three thereof protrude such that the three contact surfaces 13 vertically protrude upward. When one 3-D boss 11 is continuously connected to another, it is preferable that a contact surface 13 of the 3-D boss 11 mutually faces a contact surface of another 3-D boss.

When sunlight or light emitted from a headlamp of a vehicle is incident into the reflective panel 10 of the foldable delineator according to the embodiment of the invention, with the reflective panel 10 coupled to the guardrail G or the protective wall G', the light reaches the reflective surface 12 of the 3-D boss 11 and is reflected on the reflective surface 12 of the 3-D boss 11 toward the outside.

Then, the light incident into the unit 3-D boss 11 can be reflected to a reflective surface 12 of an adjacent unit 3-D boss 11, and the light reflected on the reflective surface 12 of the adjacent unit 3-D boss 11 can be reflected to another adjacent unit 3-D boss 11.

Accordingly, the light incident into a reflective panel 10 is continuously reflected at various angles by the 3-D bosses 11 continuously formed on the rear surface of the reflective panel 10, thereby increasing the reflectivity of the reflective panel 10.

Referring to FIG. 13, since the 3-D boss 11 that reflects light when the light is incident into the reflective panel 10 has three reflective surfaces 12, the light can be emitted three times through the three reflective surfaces 12. Furthermore, since the 3-D boss 11 can accommodate 360 degrees, even when light is incident at any angle of the 3-D boss 11, it can be reflected and emitted through the three reflective surfaces 12, thereby maximizing reflectivity.

Therefore, if the foldable delineator to which the reflective panel 10 according to the present invention is coupled is installed on a road, the reflection of light by the reflective panel 10 can be maximized, thereby doubling the attention-attracting effect of the driver.

Meanwhile, since the reflective panel 10 of the foldable delineator according to the embodiment of the invention has continuous hexagonal bottom surfaces in 3-D bosses 11, neither continuous division lines nor border lines appear in any direction.

Accordingly, when an impact is applied from the outside, the reflective panel 10 of the foldable delineator is not spit or damaged along division lines or border lines as in the prior art, thereby enhancing the durability of the reflective panel 10 and extending the lifespan of the foldable delineator.

While the invention has been shown and described with respect to the preferred embodiments, it will be understood by those skilled in the art that various changes and modifications may be made without departing from the spirit and scope of the invention as defined in the following claims.

The invention claimed is:

1. A foldable delineator comprising:

a fixing plate (100) installed at a guardrail or a protective wall and having one or more first hinge coupling portions (110) formed by bending corners thereof;

a pivotal plate (200) at which a reflective panel fixing frame (30) to which a reflective panel (10) is coupled by means of a bolt is installed, the pivotal plate (200) having one or more hinge coupling portions (210) coupled to the first hinge coupling portions (110) by means of a hinge (20) and formed by bending corners of the pivotal plate (200), one or more bending preventing bosses (220) protruding along a lengthwise direction of the pivotal plate (200) on one surface of the pivotal plate (200), and one or more bending preventing portions (230) formed by bending lengthwise edges of the pivotal plate (200);

a stopper (120) for limiting the pivoting movement of the pivotal plate (200) to a range of 90 degrees with the pivotal plate (200) being coupled to the fixing plate (100) by means of the hinge (20);

a coil spring (300) installed around the hinge (20) to support the fixing plate (100) and the pivotal plate (200) resiliently; and coupling recesses (400) formed in the fixing plate (100) and the pivotal plate (200) such that both ends of the coil spring (300) are inserted and fixed thereinto.

2. The foldable delineator of claim 1, wherein an installation hole (101) for a protective wall or a installation hole (102) for a guardrail are formed in the fixing plate (100).

* * * * *